United States Patent [19]

Appavoo

[11] Patent Number: 4,928,993

[45] Date of Patent: May 29, 1990

[54] SPLASH GUARD

[76] Inventor: Darma L. Appavoo, P.O. Box 98, Kerrobert, Saskatchewan, Canada, S0L 1R0

[21] Appl. No.: 371,197

[22] Filed: Jun. 26, 1989

[51] Int. Cl.[5] ..... G09F 21/00

[52] U.S. Cl. ..... 280/851; 40/477; 40/590

[58] Field of Search ..... 280/851, 582, 848, 152.1, 280/152.3; 180/903; 40/534, 477, 479, 617, 591, 592, 602, 493, 580, 581, 582, 588, 589, 590

[56] References Cited

U.S. PATENT DOCUMENTS

| | | | |
|---|---|---|---|
| D. 202,101 | 8/1965 | Markson | D12/185 |
| D. 235,633 | 7/1975 | Cooper | D12/185 |
| 2,546,781 | 3/1951 | Rheeling | 40/591 |
| 3,111,782 | 11/1963 | Quigley | 40/492 |
| 3,241,857 | 3/1966 | Goetz | 280/851 |
| 4,061,352 | 12/1977 | Bagne | 280/851 |
| 4,103,918 | 8/1978 | Salden | 280/851 |
| 4,318,238 | 3/1982 | Macarle, Jr. | 40/612 |
| 4,357,030 | 11/1982 | Verge | 280/851 |
| 4,453,728 | 6/1984 | Verge | 280/851 |
| 4,660,846 | 4/1987 | Morin | 280/851 |

FOREIGN PATENT DOCUMENTS

| | | | |
|---|---|---|---|
| 325259 | 2/1930 | United Kingdom | 40/477 |
| 8604712 | 8/1986 | World Int. Prop. O. | 40/592 |

*Primary Examiner*—David M. Mitchell

*Attorney, Agent, or Firm*—Murray E. Thrift; Stanley G. Ade; Adrian D. Battison

[57] ABSTRACT

A splash guard for vehicles having a main panel of conventional splash guard form. The main panel is mounted on a vehicle behind the wheels to control splash. In association with the main panel is a secondary panel that is hinged on the back face of the main panel. The secondary panel is shorter and wider than the main panel so that the projecting ends act as wings and catch the air passing the main panel when the vehicle is in motion. The two panels carry separate indicia, with indicia on the main panel being normally hidden by the secondary panel until the air passing the main panel lifts the secondary panel to expose the indicia on the main panel. The splash guard may be used for displaying advertizing, slogans, humorous sayings or illustrations.

4 Claims, 1 Drawing Sheet

SPLASH GUARD

FIELD OF THE INVENTION

The present invention relates to splash guards for trucks or other vehicles and more particularly to splash guards with a novel arrangement for displaying indicia, for example, advertising, slogans, humorous sayings or illustrations.

BACKGROUND

Various splash guard designs have been proposed, including those described in:

U.S. Pat. Nos.

2,546,781, V. S. Rheeling, Mar. 27, 1951;

3,241,857, F. T. Goetz, Mar. 22, 1966;

4,061,352, B. Gabne, Dec. 6, 1977;

4,103,918, L. Salden, Aug. 1, 1978;

4,453,728, C. A. Verge, June 12, 1984;

4,357,030, C. A. Verge, Nov. 2, 1982;

4,660,846, A. Z. Morin, Apr. 28, 1987;

U.S. Des. Pat. Nos.

235,633, C. L. Cooper, July 1, 1975;

202,101, M. Markson, Aug. 31, 1965.

U.S. Pat. Nos. 413,418; 4,357,030; and 4,453,728 all relate to multi-component splash guards with lower parts pivotally connected to fixed upper panels and spring biased against pivotal movement.

U.S. Pat. No. 4,660,846 describes a multi-part splash guard that deflects spray passing through the guard downwardly and to one side.

U.S. Pat. No. 2,546,781 describes a splash guard that may be converted to an emergency highway danger sign.

U.S. Pat. No. 3,241,857 describes a splash guard with an advertising pocket on its back face.

U.S. Pat. No. 4,061,352 describes a splash guard molded with a decorative, multi-coloured design on the back face.

U.S. Des. Pat. No. 235,633 describes a splash guard with a square dancing motif in relief on the back surface.

U.S. Des. Pat. No. 202,101 illustrates a splash guard with a three dimensional configuration in the shape of a caricature of a human face.

SUMMARY

The aim of the present invention is to provide a splash guard that may be used for displaying advertising, slogans, humorous sayings, illustrations or any other desired indicia in a novel way.

According to the present invention there is provided a splash guard for a vehicle comprising:

a main panel adapted to be mounted on the vehicle so as to depend therefrom, the main panel having a predetermined width and a predetermined height;

a secondary panel pivotally mounted on a back face of the main panel to pivot freely about a lateral hinge line and normally depending from the hinge line with a front face of the secondary panel confronting and covering a portion of the back face of the main panel, the secondary panel having a width greater than the predetermined width of the main panel and a height less than the predetermined height of the main panel;

first indicia marked on a back face of the secondary panel;

second indicia marked on that portion of the back face of the main panel that is normally covered by the secondary panel;

whereby air passing by the main panel in a front to back direction will impinge upon exposed portions of the secondary panel and pivot the secondary panel upwards to the rear, thus exposing the secondary indicia to view.

Thus, a two part communication is provided, the first part being that normally visible on the back of the secondary panel and exposed parts of the main panel when the vehicle is at rest. The second part of the communication is the indicia normally hidden by the secondary panel but exposed to view when the vehicle is in motion.

Splash guards according to the present invention are especially suited for large transport trucks, but can also be scaled down in size for a passenger vehicle or even a motorcycle.

BRIEF DESCRIPTION OF THE DRAWINGS

In the accompanying drawings, which illustrate an exemplary embodiment of the present invention.

DETAILED DESCRIPTION

Figure 3:
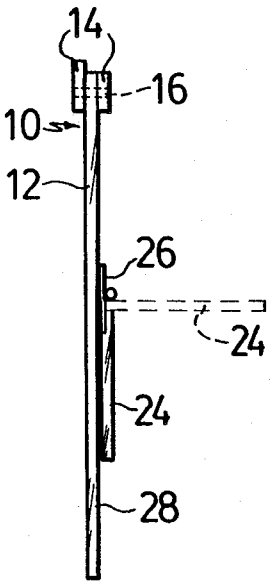
FIG. 3 is a side elevation of the splash guard.

Referring to the accompanying drawings, there is illustrated a splash guard 10 constructed according to the present invention. The splash guard has a main panel 12 of rectangular form, reinforced along the top edge by metal straps 14. Along the top edge, where the reinforcement is found, are holes 16 used to secure the splash guard to a truck body 18 using screws 20. The splash guard is mounted immediately behind a set of wheels 22. The main panel 12 of the splash guard is essentially the same as a standard splash guard.

In the present invention, the splash guard 10 includes a secondary panel 24 that is shorter and wider than the main panel 12. A hinge 26 connects the top edge of the secondary panel 24 to the back face 28 of the main panel 12 so that the secondary panel can pivot freely about a horizontal hinge line. The secondary panel 24 is mounted with its ends 30 and 32 projecting significantly beyond the side edges of the main panel 12.

Figure 2:
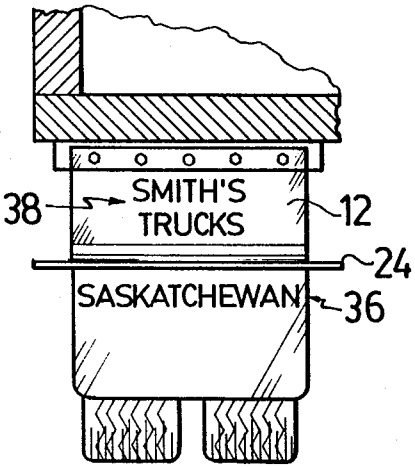
FIG. 2 is a view like FIG. 1 showing the splash guard in an in motion condition.
Figure 1:
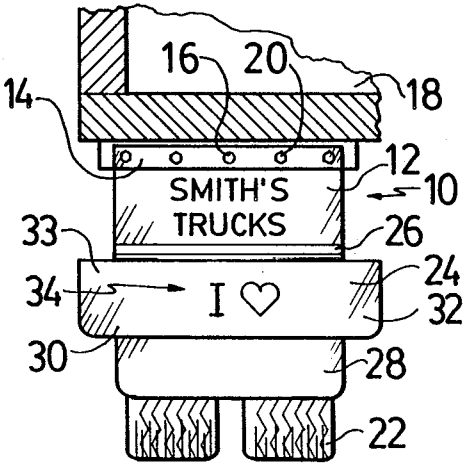
FIG. 1 is a rear view of a splash guard according to the present invention in its at rest position.

The secondary panel 24 has a back face 33 carrying indicia 34. These are normally visible when the vehicle is at rest as illustrated in FIG. 1. When the vehicle is in motion, the projecting ends at 30 and 32 of the secondary panel are exposed to the air passing the main panel from front to back, which causes the secondary panel to flip up, exposing indicia 36 normally hidden under the secondary panel on the back face of the main panel 12, as illustrated in FIG. 2. The main panel may also carry additional indicia 38 that are on the normally exposed portions of the main panel and which are logically associated with the indicia on the back of the secondary panel 24 and on the normally covered part of the main panel.

The two panels are normally made of a rubber or rubberized waterproof material as are conventional splash guards.

The indicia appearing on the splash guard may be advertising, humorous slogans, illustrations or the like, for example. One example is illustrated in FIGS. 1 and 2.

While one embodiment of the present invention has been described in the foregoing, in connection with the accompanying drawings, it is to be understood that other embodiments are possible within the scope of the present invention. The invention is to be considered limited solely by the scope of the appended claims.

I claim:

1. A splash guard for a vehicle comprising:

a main panel adapted to be mounted on the vehicle so as to depend therefrom, the main panel having a predetermined width and a predetermined height;

a secondary panel pivotally mounted on a back face of the main panel to pivot freely about a lateral hinge line and normally depending from the hinge line with a front face of the secondary panel confronting and covering a portion of the back face of the main panel, the secondary panel having a width greater than the predetermined width of the main panel and a height less than the predetermined height of the main panel;

first indicia marked on a back face of the secondary panel;

second indicia marked on that portion of the back face of the main panel that is normally covered by the secondary panel;

whereby air passing by the main panel in a front to back direction will impinge upon exposed portions of the secondary panel and pivot the secondary panel upwards to the rear, thus exposing the secondary indicia to view.

2. A splash guard according to claim 1 wherein the secondary panel extends beyond opposite side edges of the main panel.

3. A splash guard according to claim 2 wherein the secondary panel has a bottom edge spaced above a bottom edge of the main panel.

4. A splash guard according to claim 3 including third indicia marked on portions of the back face of the main panel other than the normally covered portion thereof.

* * * * *